US005295678A

United States Patent [19]

Lindner et al.

[11] Patent Number: 5,295,678

[45] Date of Patent: Mar. 22, 1994

[54] CONTROL DRIVE FOR A STACK LIFT DRIVE IN SHEET PROCESSING MACHINES, MORE PARTICULARLY SHEET PRINTING MACHINES

[75] Inventors: Bernd Lindner, Frankfurt; Albrecht Völz, Rodermark; Joachim Blumör, Hainburg, all of Fed. Rep. of Germany

[73] Assignee: MAN Roland Druckmaschinen AG, Fed. Rep. of Germany

[21] Appl. No.: 968,450

[22] Filed: Oct. 29, 1992

[30] Foreign Application Priority Data

Oct. 30, 1991 [DE] Fed. Rep. of Germany ..... 4135752

[51] Int. Cl.[5] ..... B65H 1/18

[52] U.S. Cl. ..... 271/152; 271/154

[58] Field of Search ..... 271/147, 152-154

[56] References Cited

U.S. PATENT DOCUMENTS

| | | | |
|---|---|---|---|
| 3,125,337 | 3/1964 | Cruzen | 271/154 |
| 4,273,323 | 6/1981 | Kancko et al. | 271/153 |
| 4,457,508 | 7/1984 | Eichler et al. | 271/152 |
| 4,624,454 | 11/1986 | Grützmacher et al. | 271/153 |
| 4,832,329 | 5/1989 | Rodi et al. . | |
| 5,104,109 | 4/1992 | Kubo | 271/154 |

FOREIGN PATENT DOCUMENTS

| | | | |
|---|---|---|---|
| 2659511C2 | 9/1977 | Fed. Rep. of Germany . | |
| 3607979A1 | 10/1986 | Fed. Rep. of Germany . | |
| 3631456C2 | 3/1988 | Fed. Rep. of Germany . | |
| 97525 | 9/1988 | Japan | 271/147 |
| 294125 | 11/1989 | Japan | 271/152 |
| 1535474 | 3/1977 | United Kingdom . | |

*Primary Examiner*—David H. Bollinger

*Attorney, Agent, or Firm*—Leydig, Voit & Mayer, Ltd.

[57] ABSTRACT

A system and method for controlling the lifting of a stack of sheets to be printed in order to keep the currently uppermost sheet of the stack within a certain predetermined height range for reliable removal to a feed table. A motor is operated in either a discontinuous mode or in a continuous mode to lift the sheets, the mode of operation being chosen in dependence on the speed of the press and the thickness of the sheets when compared against an established curve. A sensor is utilized to determine the vertical position of the uppermost sheet in the stack. In the continuous mode the motor speed is adjusted in accordance with the height of the uppermost sheet in the stack, while in the discontinuous mode, the motor is energized and de-energized such that the height of the currently uppermost sheet in the stack is maintained within a predetermined height range.

11 Claims, 2 Drawing Sheets

CONTROL DRIVE FOR A STACK LIFT DRIVE IN SHEET PROCESSING MACHINES, MORE PARTICULARLY SHEET PRINTING MACHINES

FIELD OF THE INVENTION

This invention relates generally to sheet feeders for sheet processing machines, and more particularly to an improved system and method for controlling the lifting of a stack of sheets to be fed to a sheet printing machine.

BACKGROUND OF THE INVENTION

In sheet processing machines, for example sheet printing machines, the sheets (i.e., printing media) to be printed are individually taken off the top of a stack of sheets as they are delivered, typically in an underlapping relationship, to a feed table. Suction-based lifting devices are then typically employed to individually remove the sheets from the stack. In order for these lifting devices to reliably engage the sheets, it is a necessary requirement that the vertical position of the upper surface of the top sheet must be maintained within a relatively narrow range of heights.

To keep the uppermost sheet within the required range, the sheets are typically stacked upon a pallet which can be raised as needed to compensate for the decline in the stack height as sheets are removed. Ordinarily, a motorized stack lift drive is provided for raising the pallet and stack of sheets so that the top surface of the uppermost sheet is within the proper height range. Since the speed that sheets are fed to the printing machine (i.e., processing machine) depends on the operating speed of the printing machine, and the height of the top of the stack varies in dependence on the sheet thickness, the drive must raise the pallet in dependence on these parameters.

To ensure that the stack is raised to the proper height, generally a stack height sensor is utilized. A control device monitors output signals from the stack height sensor, the control device operating the drive in accordance with the signals. Either discontinuous (i.e. intermittent) or continuous pallet lifting can be performed to maintain the proper stack height as the sheets are removed from the stack.

German patent DE 3 607 979 A1 discloses one such control device that continuously raises a stack lift drive. In this system the stack lift drive motor is continually operated, while the lifting motor is sped up or slowed down as needed to adjust for the varying deviations between a predetermined desired height and the actual height as determined by the stack height sensor. Although this types of system can handle the stack lifting task, a disadvantage of this system is that the motor and accompanying drive must be capable of a very large range of adjustments to ensure that the top of the stack can be kept within the narrow height range at all processing speeds of the printing machine and for all printing medium thicknesses. As can be readily appreciated, such a system is relatively complex and expensive due to the extensive performance requirements for the motor and drive.

Drives and motors that operate discontinuously to lift the stacks have lower performance requirements. One such system is disclosed in British patent 1,535,474 (corresponding to German Patent No. DE 2 659 511 C2). Instead of varying the motor speed, to operate a discontinuous drive the drive is either switched on or off to adjust the stack height in accordance with the output signal of a stack height sensor. With these type of systems, however, the higher the printing speed and/or the thicker the printing media, the higher the switching frequency must be in order to keep the top of the stack at the required height. Accordingly, the drive and motor must be designed to handle such rapid intermittent operation. More significantly, at high switching frequencies the pallet and stack tend to vibrate, particularly in the associated mechanical lifting gears. These vibrations cause the stack (including the critically positioned top sheet) to experience unpredictable movements. As a result of these vibrations, when dealing with either height speed printing or thick printing media that has a relatively heavy weight, problems often occur in attempting to reliably lift the top sheet off of the stack and accurately transport the sheets to the feed table.

Another system for controlling the lifting of the sheets is disclosed in U.S. Pat. No. 4,832,329 (corresponding to German Patent No. DE 3 631 456 C2). In this system a correction movement is calculated and performed based on a number of complex factors. A pulse generator connected to the shaft of the motor counts fractions of motor shaft revolutions so that the exact amount of correction movement itself is stored in memory and factored into the next correction movement calculation. This exact measurement allows precise compensation for parameters such as temperature, system wear and tear, voltage irregularities, and so on. The speed of the processing machine is also known, but is only used to calculate precise sheet thickness and the number of sheets removed during a correction movement. Continuous correction movement is also discussed, however the system does not switch to a continuous lifting mode based directly on the speed of the printing machine and sheet thickness, but instead on a number of complex factors including time intervals between movements and precisely calculated sheet thicknesses. While again this system accomplishes its objective, this pulse generator and memory combination (means for determining a quantity dependent on correction movement) requires complex calculations and measuring devices when only a simple vertical movement is required. As a result, such a system is far more expensive, complex and error-prone than is necessary to keep a stack of sheets within the required height range.

OBJECTS AND SUMMARY OF THE INVENTION

Accordingly, it is an object of the present invention to provide a simple control system and method for a motorized stack lift drive system that optimally selects either continuous or discontinuous lifting operation in dependence on the speed of the printing machine and the thickness of the printing medium.

It is another object of the invention to provide a control system and method that selects either a continuous or discontinuous lifting operation, thereby eliminating the need for a motor having wide-ranging operating characteristics so that only a relatively inexpensive motor and drive can reliably lift the stack over a wide range of printing speeds and printing medium thicknesses.

It is a further object of the invention to provide a simple control system and method that operates without requiring complex calculations and precise lifting measurements.

It is yet another object of the present invention to provide a stack lift system that operates reliably regardless of the printing speed and/or the printing medium thickness.

The present invention accomplishes these objects by providing a system and method for controlling a motor and associated drive means to lift a stack of at least one sheet of a predetermined thickness for feeding to a sheet processing machine. Stack height sensor means determine the vertical position of the sheet and providing a signal representative thereof. A value representative of the processing speed of the machine and the thickness of the sheet is obtained and stored in a memory means, and a control means associated with the memory means and responsive to the signal from the stack height sensor means operates the motor until the sheet is raised to a predetermined vertical position. The control means operates the motor in either a continuous mode or a discontinuous mode depending on the sheet processing speed and the thickness of the sheet.

In the preferred embodiment, the memory means further stores values representative of a predetermined curve of sheet thicknesses and processing speeds, and the control means selects between operating the motor in either the continuous mode or the discontinuous mode in dependence on the obtained sheet processing speed and the thickness of the sheet in relation to the values stored for the curve.

Preferably, when operating in the continuous mode, the control means also controls a motor speed adjustment means that is associated with the motor, so that the speed of the motor is varied in response to the signal received from the stack height sensor means.

Other objects and advantages will become apparent from the following detailed description when taken in conjunction with the drawings, in which:

DETAILED DESCRIPTION OF THE PREFERRED EMBODIMENTS

While the invention will be described in connection with a preferred embodiment, there is no intent to limit it to that embodiment. On the contrary, the intent is to cover all alternatives, modifications and equivalents included within the spirit and scope of the invention as defined by the appended claims. Moreover, it should be understood that while the present invention is described with respect to a single operating orientation, other orientations of this system are conceivable.

Figure 1:
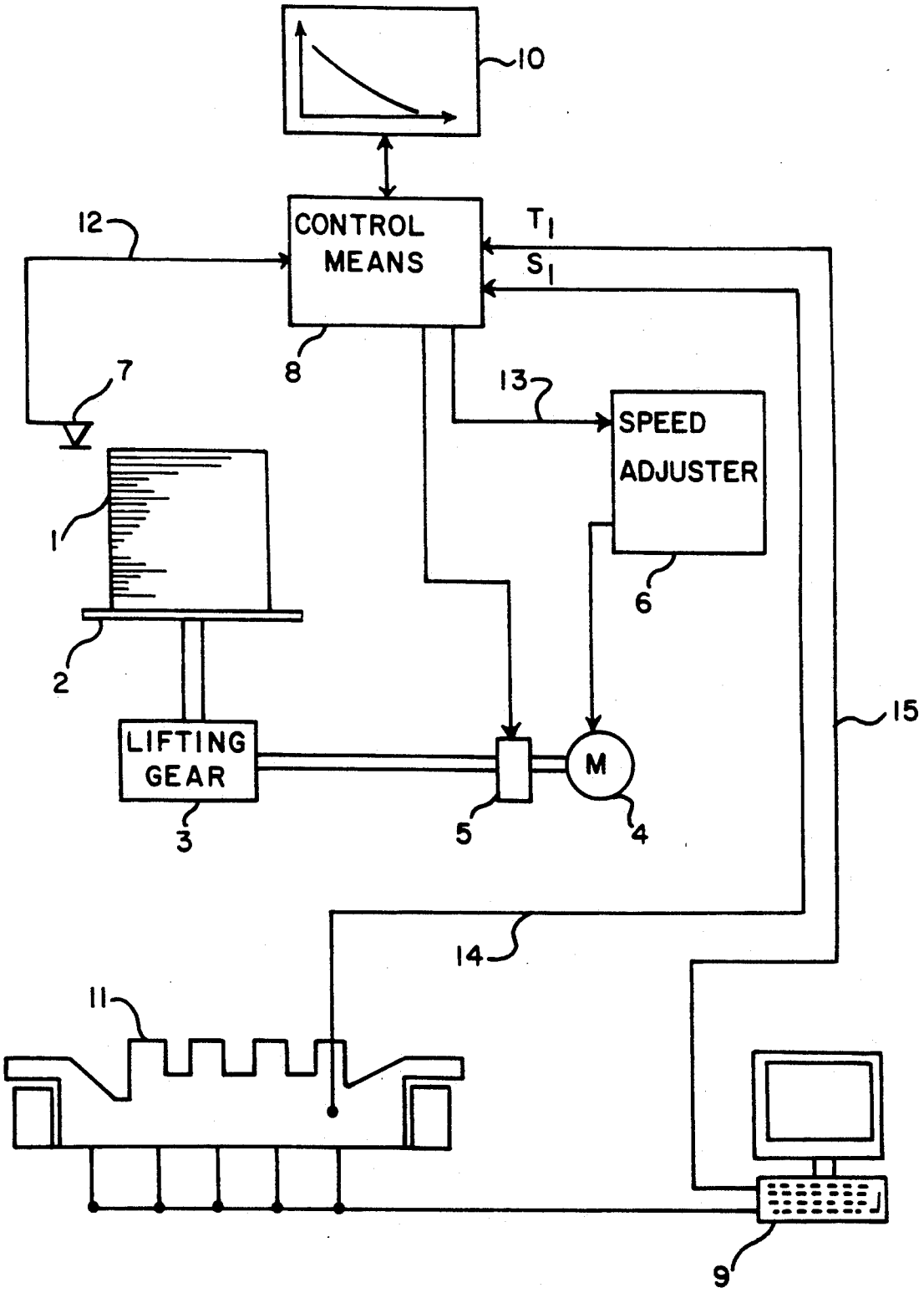
FIG. 1 illustrates a stack lift drive system according to the present invention.

Turning now to the drawings and referring first to FIG. 1, there is shown a stack of sheets 1 disposed upon a pallet 2 for printing on a printing machine 11. A lifting gear 3, driven by a motor 4, is designed to lift the pallet 2 and stack 1 whenever the motor is energized. As shown in the preferred embodiment, a brake 5 may be associated with the motor 4 so that the weight of the pallet 2 and stack 1 will not displace the pallet 2 and stack 1 from their fixed vertical position (i.e., the pallet 2 and stack 1 will remain at a given height) when the motor 4 is not operating. In an alternative embodiment, the brake 5 can be integrated directly in the motor 4, such as in a reciprocating armature motor, and the brake 5 can be actuated either independently by pulses from a control means 8 or in relation to the motor current. The control means 8 is of a well-known design, for example a microcomputer performing a simple program for inputting and outputting the various signals.

In the preferred embodiment, motor 4 is supplied with a current at a level controlled by an associated motor speed adjuster 6 of a conventional design. Preferably, the motor is a polyphase asynchronous motor, also of a conventional design, coupled to the speed adjuster 6, wherein the speed adjuster 6 allows only a narrow range of adjustment. Typically the speed adjuster 6 draws power for the motor directly from a main power source (not shown). The motor speed adjuster 6 is also connected to the control means 8 so that the speed of the motor can be automatically controlled with a value fed from the control means 8.

A stack height sensor 7 is positioned to detect the upper surface of the top sheet in the stack 1. The stack height sensor 7, is of well-known type and is preferably a simple capacitive type sensor or an optical sensor, and provides an output signal 12 indicative of whether or not the top sheet of the stack 1 is within a given height range. The output signal 12 is electrically connected to the control means 8 so that the appropriate adjustment signal 13 for controlling the speed adjuster 6 is associated with the height of the stack 1.

Additionally, the speed $S_1$ of the printing machine 11 is fed to the control means 8, such as by transmitting a tachometer signal 14 or the like from the main printing drive (not shown), or alternatively by sending a train of signal pulses at a frequency corresponding to the speed of the printing machine 11. The thickness $T_1$ of the printing medium is also fed to the control means 8 via data line 15 preferably by manual data input at a master computer 9, although conceivably the thickness $T_1$ of the printing medium could be directly entered at the control means 8 or automatically entered via a measuring device (not shown). Although not necessary to the invention, if desired the master computer 9 can be configured in a known way to monitor and run the entire printing operation.

Depending on the values of the speed $S_1$ of the printing machine 11 and the entered printing medium thickness $T_1$, the control means 8 automatically determines whether to run the lifting motor 4 in a continuous or discontinuous mode. The changeover between continuous and discontinuous lifting of the stack 1 is determined by the control means 8 in accordance with the value input for the thickness $T_1$ of the printing medium and the speed $S_1$ of the printing machine 11. Preferably, the mode is selected based on these ascertained values relative to a characteristic curve stored in memory means 10. In the preferred embodiment, the coordinates for a number of points on the curve are stored in memory means 10, which may include a Read-Only Memory (ROM). It can be readily appreciated that in the alternative, a formula corresponding to such a curve can be developed whereby plugging in the values would result in a similar determination. Although only a finite number of points can be recorded for the curve, in the preferred embodiment enough points are stored in the memory means 10 so that the lifting operations are adequately performed merely by making reasonable approximations.

Figure 2:
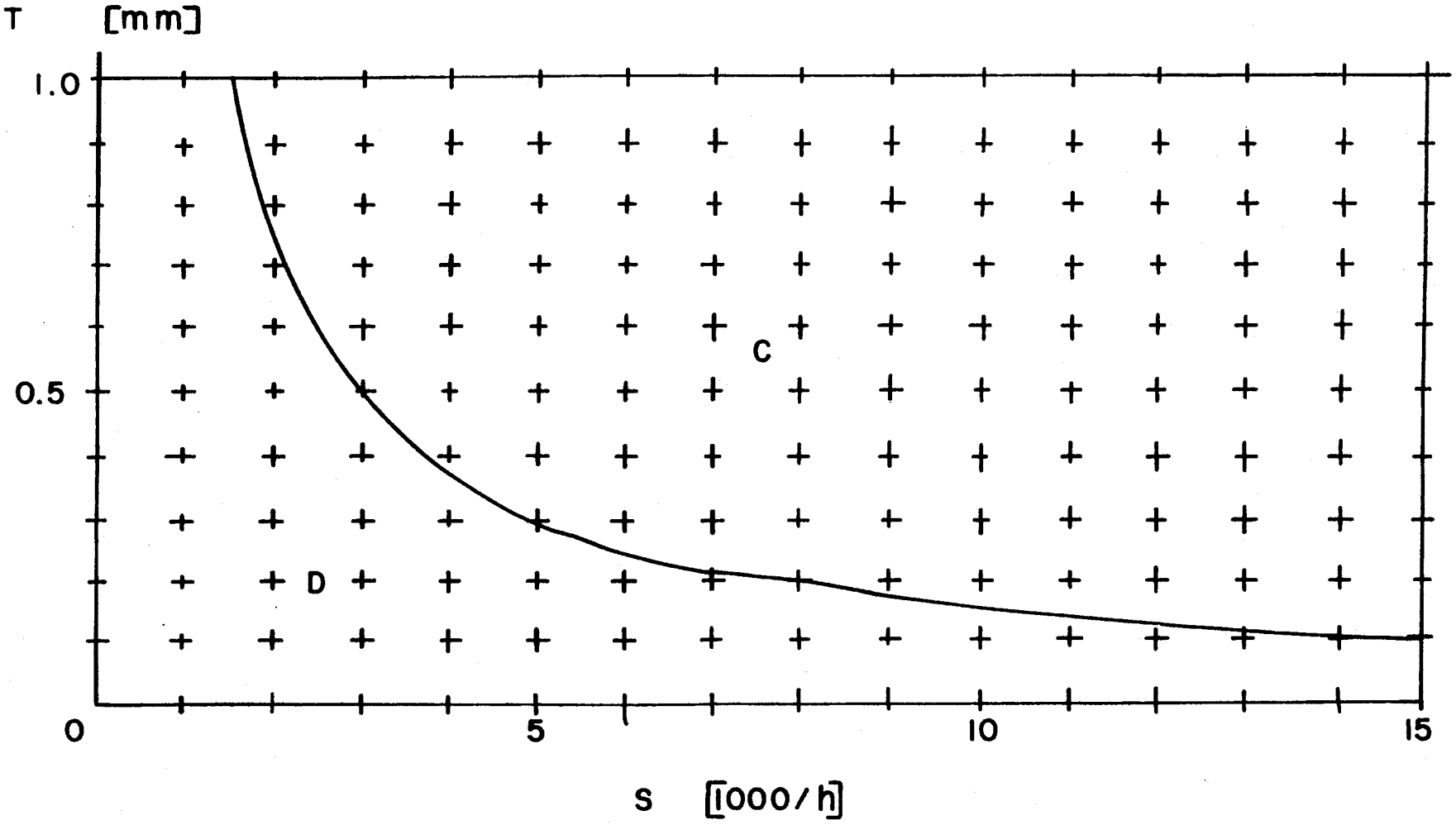
FIG. 2 shows a characteristic curve indicating the operation of the motor in either continuous or discontinuous modes as a function of printing speed and printing medium thickness.

FIG. 2 is an example of one such curve, plotted as a function of processing speed S and printing medium thickness T. In FIG. 2, the region D below the curve is where discontinuous stack operation is employed. If coordinates corresponding to the actual speed $S_1$ and thickness $T_1$ values are plotted to a point appearing in this lower area, the control means 8 enters the discontinuous mode for operating the motor 4. The region C above the curve is where continuous stack operation is employed if the corresponding actual values of $S_1$ and $T_1$ appear therein. Thus, by way of example, if the printing medium thickness $T_1$ equals 0.05 mm, an operating speed $S_1$ below 3000 sheets per hour results in discontinuous lifting of the stack. For this same thickness $T_1$, whenever the printing speed $S_1$ exceeds 3000 sheets per hour, the stack is lifted continuously by continuous operation of the motor 4.

Returning to FIG. 1, for values of speeds $S_1$ and thicknesses $T_1$ where the control means 8 selects the continuous mode, the control means 8 calculates the proper speed of the lifting motor based on the processing speed $S_1$ of the machine 11 and the sheet thickness $T_1$, taking into consideration the transmission ratio of the lifting gear 3. The control means 8 then transmits an appropriate signal 13 to the speed adjuster 6 so that the lifting motor 4 will initially operate at the calculated speed and keep the uppermost sheet in the stack 1 within the required height range as sheets are removed. The control means 8 then monitors the signals from the stack height sensor 7 in order to ensure that the motor 4 is operating at the proper lifting speed. Should the top sheet exceed the desired height, the control means 8 calculates a new, slower speed for lifting the stack 1 and transmits this to the speed adjuster 6 via line 13; should the top sheet be too low, the control means 8 increases the speed of the motor 4 by sending a new speed setting to the speed adjuster 6. In this mode, the control means 8 continually adjusts the lifting speed as needed during the entire printing operation.

Alternatively, when the control means 8 enters the discontinuous mode, the motor 4 is switched off and on depending on whether the top sheet in the stack 1 is above or below the desired height as sensed by the stack height sensor 7. In this mode, the speed of the motor 4 is not critical, and is therefore not ordinarily modified, although such a hybrid system is conceivable. In the preferred embodiment, the stack height sensor 7 is set to detect the maximum allowable height in the range. When this maximum height is sensed while in the discontinuous mode, the control means 8 stops the motor 4 until a fixed number of sheets are removed thereby lowering the stack to a known level (since the thickness $T_1$ of the sheets is known). At this time, the motor 4 is then re-energized until once again the upper height limit is reached.

As can be readily appreciated, a number of other ways to determine when to intermittently energize the motor 4 are conceivable without departing from the spirit and scope of the present invention as defined by the appended claims. These other ways might include energizing the motor 4 after waiting a fixed time interval once the upper limit is no longer sensed; sensing for the stack height just below the midpoint of the acceptable height range and running the motor 4 for a short time longer so that the top of the stack essentially oscillates around the midpoint of the desired range; and so on.

Thus, as can be seen from the foregoing detailed description, a simple, inexpensive and reliable system and method for lifting a stack of sheets is provided by utilizing the control means containing the aforementioned features. This system and method operates with a motor having only a narrow speed range yet provides a reliable lifting operation regardless of the thickness of the sheets and the printing speed.

We claim:

1. A system for controlling a drive means to drive a motor to lift a stack of at least one sheet of a predetermined thickness for feeding to a sheet processing machine, the system comprising:

stack height sensor means for determining the vertical position of the sheet and providing a signal representative thereof;

means for obtaining a value representative of the processing speed $S_1$ of the machine;

means for obtaining a value representative of the thickness $T_1$ of the sheet;

memory means for storing the values representative of the speed of the processing machine $S_1$ and the sheet thickness $T_1$; and control means in communication with the memory means and responsive to the signal from the stack height sensor means for operating the drive means to drive the motor until the sheet is raised to a predetermined vertical position, the control means operating the motor in either the continuous mode or the discontinuous mode in dependence only on the values of the sheet processing speed $S_1$ and the thickness $T_1$ of the sheet.

2. The system of claim 1 wherein the memory means further stores values representative of a predetermined curve of sheet thicknesses T versus processing speeds S, and the control means operates the motor in either the continuous mode or the discontinuous mode in dependence on the obtained value $S_1$ representative of the sheet processing speed and the obtained value $T_1$ representative of thickness of the sheet in relation to the values stored for the established curve.

3. The system of claim 1 further comprising motor speed adjustment means, the motor speed adjustment means being controlled by the control means to regulate the motor speed, wherein the control means varies the speed of the motor via the motor speed adjustment means in response to the signal received from the stack height sensor means when the stack is lifted in the continuous mode.

4. The system of claim 1 wherein the motor is a polyphase asynchronous motor.

5. The system of claim 1 wherein the means for obtaining a value $T_1$ representative of the thickness of the sheet is a master computer including means for manually entering the value therein.

6. The system of claim 1 further comprising a lifting gear and brake coupled to the motor for maintaining the vertical position of the stack of sheets when the motor is not operating.

7. The system of claim 6 wherein the operation of the brake is controlled by the control means.

8. A method for lifting a stack of sheets to be processed so that the uppermost sheet in the stack is within a predetermined height range, the method comprising the steps of:

ascertaining the thickness $T_1$ of the sheets and the speed $S_1$ of the processing unit;

determining whether to lift the sheets in a continuous or discontinuous mode based only on the thickness $T_1$ of the sheets and the speed $S_1$ of the processing unit;

operating a variable-speed motor to lift the stack of sheets according to the mode selected;

monitoring a sensor to determine when the uppermost sheet in the stack is within the predetermined height range;

removing sheets from the stack; and a) when operating in the continuous mode, adjusting the speed of the motor so that the uppermost remaining sheet remains within the predetermined height range as sheets are removed from the stack, or b) when operating in the discontinuous mode, energizing and de-energizing the motor so that the uppermost remaining sheet remains within the predetermined height range as sheets are removed from the stack.

9. The method of claim 8 wherein the step of determining whether to lift the sheets in a continuous or discontinuous mode depends on a comparison of the ascertained thickness $T_1$ of the sheets and the ascertained speed $S_1$ of the processing unit against an predetermined curve representative of established sheet thicknesses and processing speeds.

10. The method of claim 8 wherein the motor is coupled to a lifting gear and brake, further comprising the step of braking the lifting gear to prevent vertical movement of the stack of sheets when the motor is deenergized.

11. The method of claim 8 wherein the step of ascertaining the thickness $T_1$ of the sheets comprises manually entering a value representative thereof into a master computer.

* * * * *